US006257913B1

(12) United States Patent
Kropa et al.

(10) Patent No.: US 6,257,913 B1
(45) **Date of Patent: *Jul. 10, 2001**

(54) LATCH MECHANISM FOR ELECTRICAL CONNECTOR

(75) Inventors: Wayne Kropa, Clarks Summit; Raymond Busacco, Lake Ariel, both of PA (US)

(73) Assignee: Berg Technology, Inc., Etters, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/461,539

(22) Filed: Dec. 15, 1999

(51) Int. Cl.[7] ..... H01R 13/627
(52) U.S. Cl. ..... 439/353; 439/953
(58) Field of Search ..... 439/353, 357, 439/358, 953

(56) References Cited

U.S. PATENT DOCUMENTS

| | | | |
|---|---|---|---|
| D. 409,148 | 5/1999 | Yotsutani et al. | D13/147 |
| 2,760,174 | 8/1956 | Burtt et al. . | |
| 5,088,935 | 2/1992 | Dise et al. | 439/573 |
| 5,123,858 | 6/1992 | Haag et al. | 439/347 |
| 5,197,901 | 3/1993 | Hashiguchi | 439/352 |
| 5,340,329 | 8/1994 | Hirai | 439/75 |
| 5,383,794 | 1/1995 | Davis et al. | 439/352 |
| 5,522,731 | 6/1996 | Clark et al. | 439/108 |
| 5,741,150 | 4/1998 | Stinson et al. | 439/358 |
| 5,775,931 | 7/1998 | Jones | 439/358 |
| 5,860,826 | 1/1999 | Chang | 439/358 |

*Primary Examiner*—Khiem Nguyen
*Assistant Examiner*—Javaid Nasri
(74) *Attorney, Agent, or Firm*—Perman & Green, LLP

(57) ABSTRACT

A connection between a one and another electrical connector uses a cable terminating assembly with at least one sidewall compartment in which a terminal end of a latch element is disposed. The terminal end of the latch element has a bell shaped cut out formed in it which cooperates with a guide post associated with the other of said connectors so that upon movement of the two connectors toward one another in locking engagement between the two is effected by the continued axial movement of the two connectors. Disconnect is accomplished by simply squeezing the latch elements to effect disengagement from the guide posts.

17 Claims, 3 Drawing Sheets

LATCH MECHANISM FOR ELECTRICAL CONNECTOR

BACKGROUND OF THE INVENTION

Field of the Invention

The present invention relates to a connector assembly for coupling one connector to a mating component, and relates more particularly to an improvement in a latch/release mechanism for releasably coupling the connector to the mating component without the hitherto known need to do so using tools.

Connector devices which are known are disclosed as follows:

Davis et al. U.S. Pat. No. 5,088,935, issued on Feb. 18, 1992 discloses a latch actuator for a connector which employs a sliding actuator which coacts with pivoting latches. The clasps engage the standoffs at outside portions opposite the location of the connector.

Haag et al. U.S. Pat. No. 5,123,858, issued on Jun. 23, 1992 discloses a lockable electrical connector having struts mounted to a slide which engage with retaining grooves. Portions of the slide reside outside of the pins.

Hashiguchi U.S. Pat. No. 5,197,901, issued on Mar. 30, 1992 and Hirai U.S. Pat. No. 5,340,329 Aug. 23, 1994 disclose a lock-spring and lock-equipped connector which use operating sections located externally of an associated pivoting lock spring disposed inwardly thereof. The locks engage the posts at outside portions that are opposite the location of the connector.

Clark et al. U.S. Pat. No. 5,522,731, issued on Jun. 4, 1984 discloses a shielded cable connector which uses a pair of side walls having a plurality of spring contacts. The side walls require intervention (such as a tool) to disengage from the mating connector.

Stinson et al. U.S. Pat. No. 5,741,150, issued on Apr. 21, 1998 discloses a unitary spring latch for an electrical connector assembly which employs a pivoted latch mechanism which latch involves numerous bends and punches to effect functionality. The latch engages the post at an outside location relative to the connector.

Jones U.S. Pat. No. 5,775,931, issued on Jul. 7, 1998 discloses externally located latch members which are fixed midlength to the connector to effect a pivotal connection. The latch member engages an over portion of the post.

Chang U.S. Pat. No. 5,860,826, issued on Jan. 19, 1999 discloses an electrical connector fastener configured to cooperate with fasteners having an enlarged head. The remaining plate engages the fastener on an outer portion.

Burtt et al. U.S. Pat. No. 2,760,174, issued on discloses a locking mechanism for connectors, but does not employ side compartments to house the latch mechanism, nor are there any post type connectors used. A portion of the locking mechanism extends outwardly past the projection of the locking lug.

As can be seen from these devices, there is a need for quick connect latch and release mechanisms for cable terminators which cooperate with corresponding structure on the header or corresponding part to lock the terminator in place. A need also exists to provide a latch assembly, that is compact. In addition, the process of connecting the cable terminator to the header requires the user be assured that a positive connection has been achieved. The importance of having such an assurance is that the user is able to know that positive contact between all the contacts of the header and those of the cable terminator or between two coacting terminators is achieved thereby assuring a complete electrical connection between the two parts.

Accordingly, it is an object of the invention to provide a device associated with the connection between, for example, a cable terminator and a header, or between two complementary formed cable terminators which are connected together such that the connection is capable of rapid latch and release without the need of tools for plugging or unplugging the connection.

It is still a further object of the invention to provide an electrical connector of the aforementioned type which provides an audible click during the interconnect process thereby signaling to the user that a positive lock condition of the connector with its corresponding part has been attained.

A further object of the invention is to provide a latch element usable in the aforesaid connector which is manufactured from a material that exhibits a high elastic limit in memory such that, depending on the particular design requirements, the material can be punched and formed into a spring latch capable of effecting the aforesaid ends.

Still a further object of the invention is to provide a quick latch spring release mechanism for a cable assembly which effects smooth engagement between the latch and a profiled locking head allowing the spring latch to smoothly engage the profiled head and lock into position with it.

Yet still a further object of the invention is to provide a quick latch spring release mechanism for a cable assembly of the aforementioned type which employs a spring latch mechanism which is enclosed within a housing of a terminator body.

Another object of the invention is to provide a latch element usable in the aforesaid connector which is compact.

Other objects and advantages of the invention will become apparent from the following description and in the appended claims.

SUMMARY OF THE INVENTION

The invention resides in a quick latch/release mechanism in a connector, which could be used in a cable assembly, which provides both rapid latch and release of the cable terminator from the mating component, such as a header to which it is fastened, without requiring tools for plugging/unplugging the cable assembly. The connector includes a body portion; a conductive element secured to said body portion for engaging a corresponding conductive element on the complementary connector; and at least one elongated latch element having one end fixed to said body portion and having another opposite free end disposed for deflection by the guide post of the corresponding connector during mating, said opposite free end of said elongated latch element having a recess formed thereat for engaging with and releasably connecting to the guide post of the corresponding connector received to effect positive locking.

Ideally, the latch element is a generally elongated metal leaf spring and a recess is formed in the free end of the latch element as a bell-shaped cutout having a base defining the bottom of the bell-shaped cutout, the base of the cutout being orientated generally perpendicularly to the longitudinal extent of the latch element.

Preferably, the body of the cable terminating assembly has bow cut portions extending inwardly transversely of the central axis thereof and coinciding with the location of a length of the latch element juxtaposed thereto and the latch element one end being secured to the body portion such that it is normally outwardly biased in a direction transversely outwardly of the central axis.

In the preferred embodiment, the latch element has a bow shape intermediate of its length which coincides positionally with the location of a respective one of the bow cut portions so as to cooperate with the body portion to allow release of the latch element from a guide post when the latch element is squeezed against the body portion.

Ideally, the at least one sidewall compartment is provided as part of the body portion and has a journaling surface having a longitudinal extent extending in a direction parallel to the central axis and being disposed between the top and end openings. The journaling surface is correspondingly sized and shaped to receive and bear against the outer surface of a guide post. The connector preferably has two sidewall compartments each respectively disposed generally coincidentally with one of the first and second side ends and each is adapted to receive a guide post therein in a direction parallel to the central axis of the assembly.

Desirably, the top opening in the top surface of the at least one sidewall compartment defines a straight edge against which the latch element is normally biased when the connector is in an unconnected condition.

DETAILED DESCRIPTION OF THE PREFERRED EMBODIMENT

Figure 1:
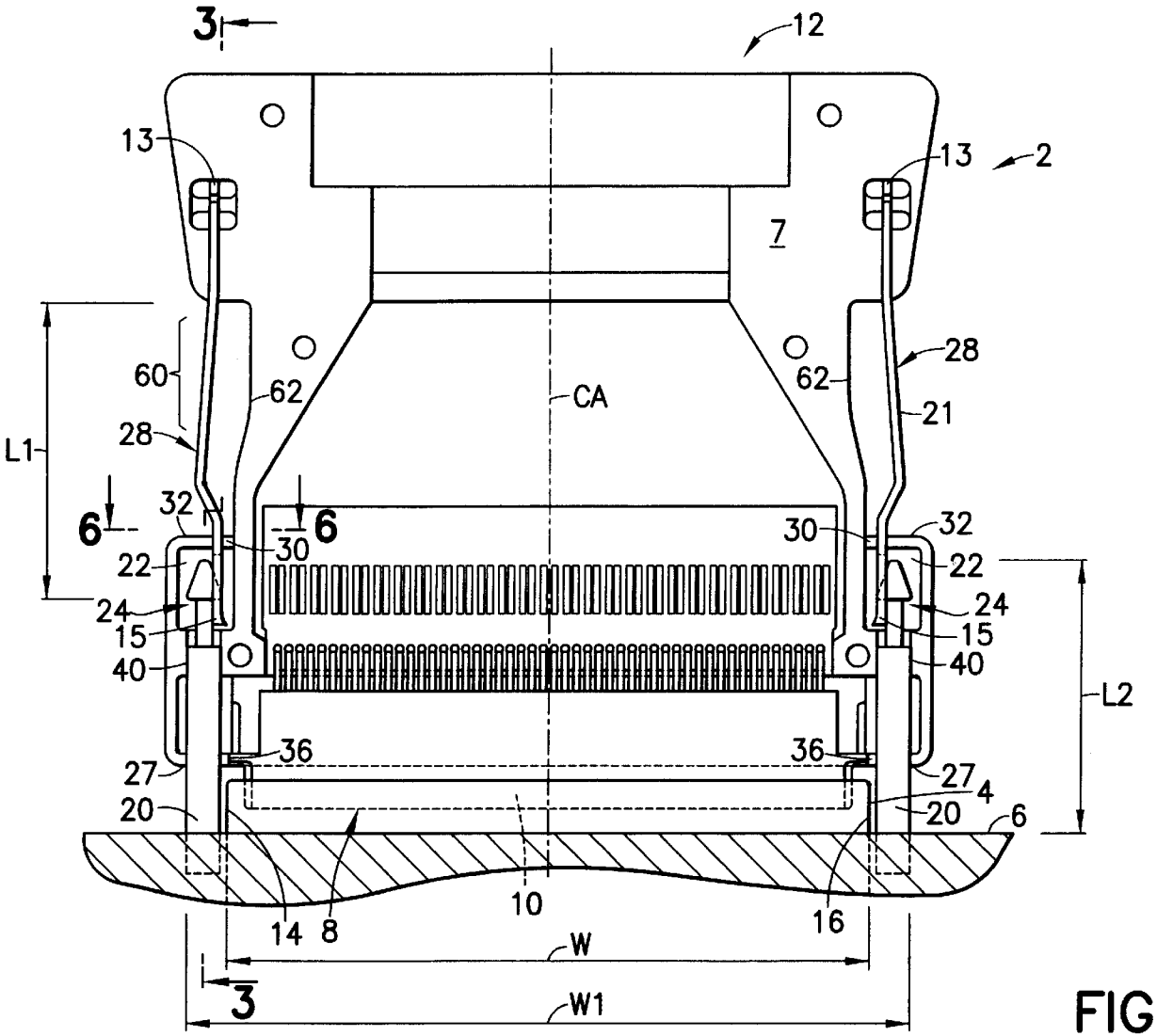
FIG. 1 is a partially fragmentary front elevation view showing a cable terminator connected to the transverse side of a support surface using the latch device of the present invention.
Figure 2:
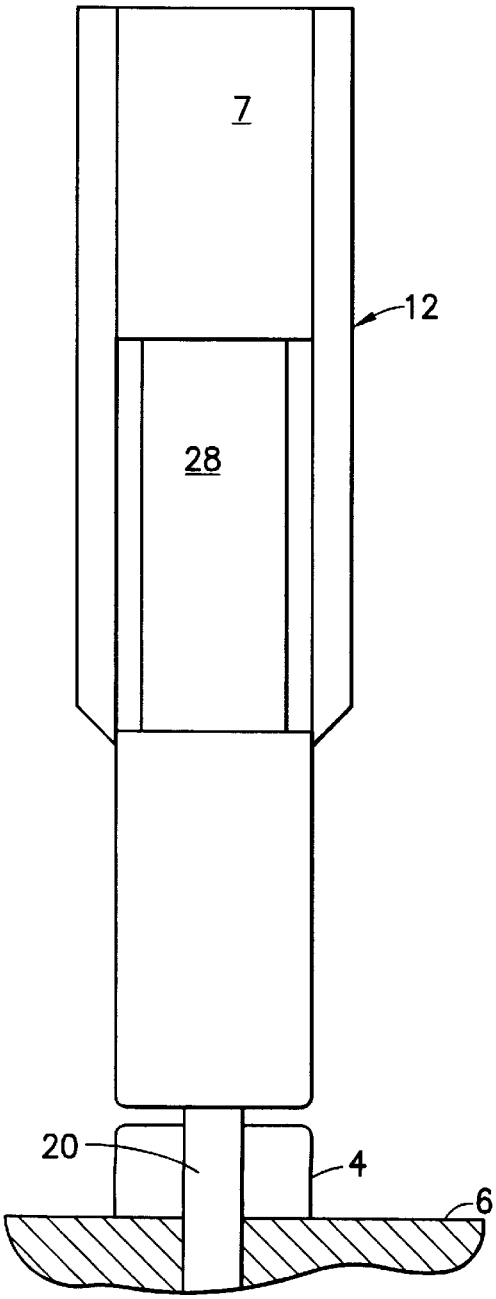
FIG. 2 is a partially fragmentary side elevation view of the cable termination assembly connector shown in FIG. 1.
Figure 3:
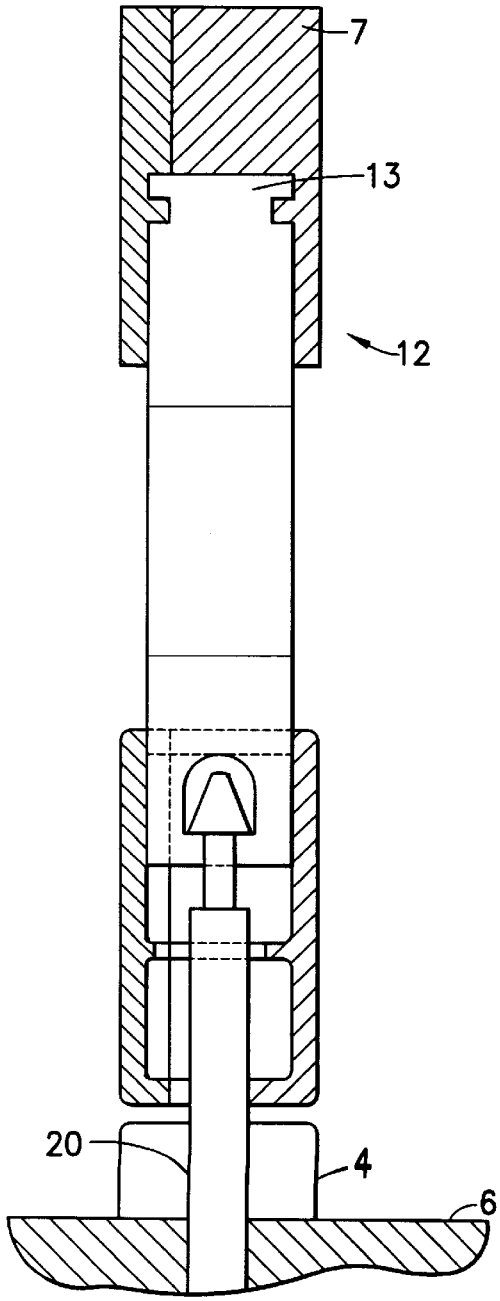
FIG. 3 is a vertical sectional view taking along line 3—3 of FIG. 1.

Referring now to FIG. 1, the invention is embodied in a connection referenced generally as 2 between electrical connectors. One half of the connection 2 can be comprised of a receptacle connector 4 which extends outwardly from a support surface 6 which, for example, may take the form of the back housing of a personal computer or the like. The other half of the connection 2 can be a cable terminating assembly 12.

Since the present invention could be used with any type of connector, only a brief description of the connector shown in the figures follows. The receptacle connector 4 has an internal socket 8 in which are disposed a plurality of terminals or contacts, as is known in the art. The socket 8 is further adapted to receive a corresponding male portion 10 of a cable terminating assembly 12 such as a card edge. The male portion 10 extends outwardly in a direction parallel to the direction of the central axis CA of the assembly 12 and is preferably disposed transversely along the front face of a cable terminating assembly 12.

The receptacle connector 4 which is mounted to the support surface 6 has a width W which is defined in part by a first end 14 and a second end 16 of the socket 8. Disposed coincidentally with and proximate each of the longitudinal ends 14 and 16 of the receptacle connector is a fixedly mounted guide post 20,20 which extends outwardly from and generally perpendicularly to the support surface 6 a given distance L2 and each define the outer limits of the width dimension W.

The cable terminating assembly 12 has body portion 7 of a width W1 which is at least equal in dimension to the width W of the receptacle connector 4. The body can house a PCB to which wires (not shown) from one or more cables secure. The other end of the PCB can have conductive pads along an edge to mate with receptacle 4. The receptacle connector width W is further prescribed by two distal end compartments 22,22 which provide the means 24 for aligning, locking and unlocking the cable terminating assembly 12 to/from the receptacle connector 4 in a new and unobvious way as will become more readily apparent. The body portion 7 could be formed from, for example, two mateable half shells.

The means 24 disposed in the terminating assembly 12 includes a cantilevered spring latch 28 which is normally directed substantially parallel to the central axis CA of the body 7 of the assembly 12 and has one end 13 which is fixedly attached to and within the body 7 of the cable terminating assembly and has an opposite free end 15 which is movable inwardly toward the central axis CA of the cable terminating assembly 12 when squeezed by a user or when initially engaging guide post 20.

Figure 6:
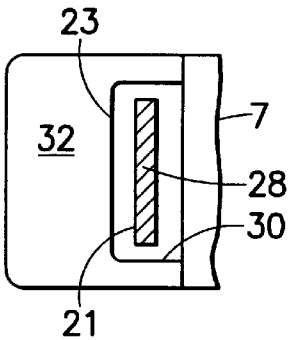
FIG. 6 is a partially fragmentary view taken on lines 6—6 of FIG. 1.

Each of the distal end compartments 22,22, as illustrated in the top partially fragmentary view in FIG. 6, has a generally rectangular top opening 30 formed on the top surface 32 thereof. The portion of the spring latch 28 associated with the free end 15 is received within an associated one of the distal end compartments 22,22 such that the outwardly disposed side face 21 of the latch 28 is engaged by the side surface 23 of the top openings 30,30 so as to positionally maintain the spring latch 28 against further outward movement when the cable terminating assembly is not connected with the receptacle connector 4. Also, in the unconnected condition of the connector, these side surfaces of the top openings 30,30 also respectively locate the corresponding free ends 15,15 of the spring latches 28,28 in an aligned condition with corresponding portions on the guide posts 20,20 so that upon continued axial movement of the assembly 12 along the axis CA on the guide post 20,20, the assembly 12 automatically locks with the guide posts 20, 20 in accordance with a further aspect of the invention.

The end face 27 facing the support surface 6 of each of the distal end compartments 22,22 has an end opening 36,36 which is respectively aligned with one of top openings 30,30 in the assembly 12 and each is spaced apart from one another by a given distance so as to be in spatial correspondence with the guide posts 20,20. Each end opening 36,36 is also correspondingly sized and shaped to receive an associated one of the guide posts 20,20 therewithin. Each distal end compartment 22,22 further has an internal cylindrical journaling surface 40,40 which is located in axial alignment with the top and end openings 30 and 36 in each side compartment 22,22, and each is correspondingly sized and shaped to act in close tolerance with the outer surface of a respective one of the guide posts 20,20 received therein to provide a bearing surface thereagainst to further add stability and strength to the connection.

Figure 4A:
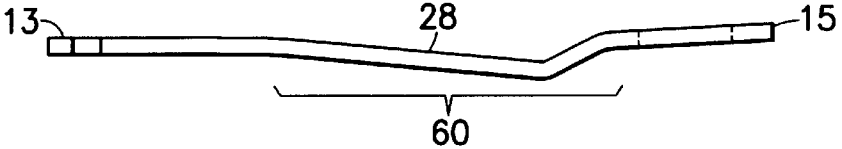
FIGS. 4A and 4B show respectively a side and a top plan view of the spring latch of the invention.
Figure 4B:
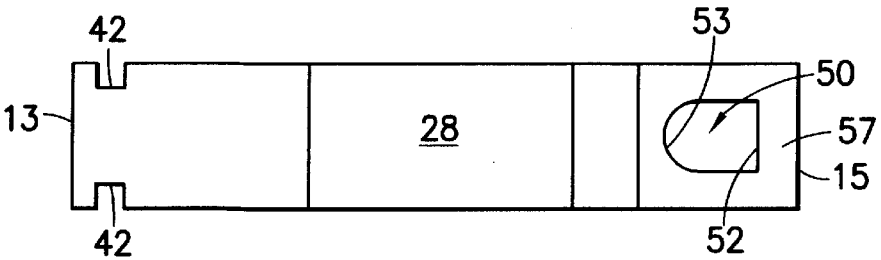

Referring now to FIGS. 4A and 4B, and in particular to the detailed construction of the spring latch 28, it should be seen that each of the spring latch elements 28,28 is formed from a suitable resilient material such as a strip of high memory metal leaf spring whose fixed end 13 is secured against movement within the body 7 of the cable terminating apparatus 12 through the intermediary of locking notches 42,42 formed therein.

Figure 5:
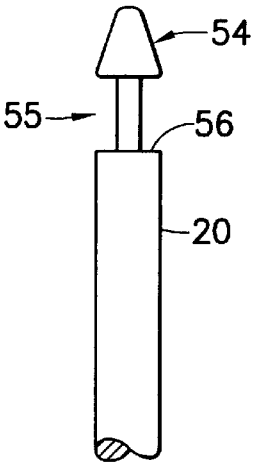
FIG. 5 is a partially fragmentary view showing the guide post in detail of the lead used in the connection of the present invention.

Proximate the free ends 15,15 of the spring latches 28,28 is a generally bell-shaped recess or cutout 50,50 formed therein. Each of the cutouts 50,50 has a flat base portion 52 connected to an arch-shaped upper portion 53 adapted to cooperate in a receiving, releasable locking engagement with a correspondingly shaped conical lead portion 54 (see FIG. 5) formed at the distal end of each of the guide posts 20,20.

The lead portions 54,54 of the guide posts 20,20 each has an undercut portion 56,56 which provides an annular recess or release area 55 in which the a portion of the spring latch between the tip of the free end 15 and the flat base portion 52 of the cutout 50,50 locks into under outward bias upon the continued movement of the assembly 12 towards the receptacle connector 4 in the indicated arrow direction along the axis CA. In other words, length L1 represents the effective length of the spring latch 28 from its fixed end to the flat base portion 52 of the bell-shaped opening 50 at the free end 15 thereof. Similarly, dimension L2 represents the effective length of guide posts from the header or support surface 6 to the shouldered annular recess 55 on the guide posts. The dimensions L1 and L2 are selected relative to one another, and to the effective dimensions of the corresponding fitting parts of the male portion 10 of the cable terminator assembly 12 and the corresponding receptacle connector socket 8 such that as the cable terminator assembly 12 is moved axially along axis CA along the guide posts 20,20, the male portion 10 of the assembly 12 and the socket 8 of the receptacle connector 4 mate to one another while at the same time the free ends 15,15 of each latch 28 are ramped over the conical surfaces of the lead portions 54,54 of the posts 20,20 and upon the end of such relative axial movement between the male part 10 and the socket 8, the spring latch elements 28,28 simultaneously pop outwardly within the respective ones of the recesses 55,55 to lock the cable terminating assembly 12 against axial movement onto the guide posts 20,20 relative to the header 6. As seen in FIG. 1, latches 28 do not extend outwardly past posts 20. In other words, latches 28 remain between posts 20.

In accordance with another feature of the invention, the spring latches 28,28 are outwardly bowed at portions 60,60 along their length. This bowed portion of the length of each of the spring latches 28,28 coincides with inwardly directed bow-cuts 62,62 formed in the body 7 of the cable terminating assembly 12 which allows the cable terminating assembly 12 to be readily and quickly removed from the posts 20 by simply squeezing the two opposing spring latches together toward the indicated central axis CA. In this way, a quick release mechanism is provided without the need of additional mechanisms, such as for example, a housing slide. It should further be appreciated that the connection that is described herein requires no tools to effect connecting and disconnecting the cable terminating assembly 12 with the header 6. In addition, the axial movement of the cable terminating assembly 12 along the central axis CA ultimately results in the spring latches 28,28 resiling into the recesses 55,55 formed on the guide posts 20,20. This resiliency creates an audible click upon contact with posts 20 which provides the user with a signal indicating that a positive locked condition has been attained which is desirable in the field as previously discussed.

Accordingly, the present invention has been described by way of the illustrated embodiment. However, numerous modifications and substitutions may be had without departing from the spirit of the invention. For example, while the guide posts 20,20 are disclosed in the preferred embodiment as being cylindrical members, it is well within the purview of the invention to form such posts, for example, with square cross sectional configurations and to form corresponding shaped bearing surfaces on the journaling parts 40,40 in a like manner.

Accordingly, the invention has been described by way of illustration rather than limitation.

What is claimed is:

1. An electrical connector having a central axis for engaging a mating electrical connector having at least one guide post and having a conical lead portion with an apex projecting toward the electrical connector and an undercut portion extending away from the conical lead portion, the electrical connector comprising:

a body portion;

a conductive element secured to said body portion for engaging a corresponding conductive element on the mating electrical connector; and at least one elongated latch element being a generally elongated cantilevered leaf spring having a first end fixed to said body portion and having a second opposite free end disposed for deflection by the guide post of the mating electrical connector during the mating operation, said opposite free end of said elongated latch element having a recess formed thereat for releasably engaging with the undercut portion of the guide post of the mating electrical connector, allowing the undercut portion of the guide post to project through the recess to effect positive locking while unlocking is achieved by the application of force on the latch element directed toward the central axis.

2. The electrical connector as defined in claim 1 further characterized by said recess in said free end of said at least one latch element being a bell-shaped cutout having a base defining the bottom of the bell-shaped cutout, said base of said cutout being orientated perpendicularly to the longitudinal extent of said latch element for engagement with the undercut portion extending away from the conical lead portion.

3. The electrical connector as defined in claim 1 further characterized by said body portion having bow cut portions extending inwardly transversely of said central axis thereof and and generally coextensive with the length of said at least one latch element juxtaposed thereto.

4. The electrical connector as defined in claim 3 further characterized by said at least one latch element having a bow shape intermediate of its length which is coextensive with one of said bow cut portions so as to accommodate movement of the latch element toward said body portion to allow release of said at least one latch element from a guide post when the latch element is squeezed against said body portion.

5. The electrical connector as defined in claim 1 further characterized by said at least one latch element first end being secured to said body portion such that it is normally outwardly biased in a direction transversely outwardly of said central axis.

6. The electrical connector as defined in claim 1 further characterized by said body portion having at least one sidewall compartment having a journaling surface extending longitudinally in a direction parallel to the central axis and being disposed between top and end openings formed in said at least one sidewall compartment, said journaling surface being correspondingly sized and shaped to receive and bear against outer surface of the guide post.

7. The electrical connector as defined in claim 6 further characterized by a top opening in a top surface of said at least one sidewall compartment defines a straight edge lying in a plane extending parallel to the central axis against which said leaf spring is normally biased when said connector is in an unconnected condition.

8. The electrical connector as defined in claim 1 further characterized by said body portion having two opposed sidewall compartments each respectively disposed generally coincidentally with first and second sides thereof, each having a journaling surface extending longitudinally in a direction parallel to the central axis and by said mating electrical connector having a pair of spaced apart stationary guide posts, each of the sidewall compartments adapted to receive a guide post therein in a direction parallel to the central axis.

9. An electrical connector for connection with a mating electrical connector having two fixed guide posts extending away therefrom and spaced apart by a predetermined distance, at least one of the guide posts having a conical lead surface with an apex projecting toward the electrical connector and an adjoining recess portion thereon comprising:

the electrical connector having a body portion extending along a central axis thereof;

said body portion having two spaced apart sidewall compartments on opposite side ends thereof;

each of said sidewall compartments having an opening extending in the direction parallel to said central axis, the openings being spaced apart from one another by the predetermined distance spacing of said guide posts so as to receive one of the guide posts therein of the mating electrical connector; and at least one of said sidewall compartments having a leaf spring therein, said leaf spring having a first end secured to said body of said connector and a second free end thereof received within said sidewall compartment and being biased transversely relative to the central axis, said leaf spring having a cut-out formed in the free end thereof for releasably locking with the at least one lead surface formed on the guide posts, the cut-out allowing the recess portion of the guide post to project therethrough to effect positive locking while unlocking is achieved by the application of force on the latch element directed toward the central axis.

10. The electrical connector as defined in claim 9 further characterized by a recess formed in said free end of said latch element having a bell-shaped cutout having a base defining the bottom of the bell-shaped cutout, said base of said cutout being orientated perpendicularly to the longitudinal extent of said leaf spring.

11. The electrical connector as defined in claim 9 further characterized by said body portion having bow cut portions extending inwardly transversely of said central axis thereof and coextensive with the length of said latch element juxtaposed thereto.

12. The electrical connector as defined in claim 9 further characterized by said latch element having a first end secured to said body of said electrical connector such that it is normally outwardly biased in a direction transversely outwardly of said central axis.

13. The electrical connector as defined in claim 9 further characterized by said leaf spring having a bow shape intermediate of its length which is positionally coextensive with the location of a respective one of said bow cut portions in said body portion so as to cooperate with said body portion to allow release of said latch element from a guide post when the latch element is squeezed against said body portion.

14. The electrical connector as defined in claim 9 further characterized by said at least one sidewall compartment having a journaling surface extending longitudinally in a direction parallel to said central axis and being disposed coincidentally with the first opening, said journaling surface correspondingly sized and shaped to receive and bear against the outer surface of a guide post.

15. The electrical connector as defined in claim 9 further characterized by said connector having two spaced apart sidewall compartments each respectively disposed generally coincidentally with one of said first and second side ends and each adapted to receive one of the guide posts therein in a direction parallel to said central axis of said assembly.

16. The electrical connector as defined in claim 9 further characterized by a top opening in a top surface of said at least one sidewall compartment defines a straight edge lying in a plane extending parallel to the central axis against which said latch element is normally biased.

17. An electrical connector for engaging a mating electrical connector flanked by two guide posts, each having a conical lead portion with an apex projecting toward the electrical connector and an undercut portion extending away from the conical lead portion, the electrical connector comprising:

two latch members engageable with said guide posts, each latch member having a recess formed thereat for releasably engaging with the undercut portion of the guide post of the mating electrical connector, allowing the undercut portion of the guide post to project through the recess to effect positive locking, said latch members remaining substantially between said guide posts.

* * * * *